US008197193B2

(12) United States Patent
Messmer

(10) Patent No.: US 8,197,193 B2
(45) Date of Patent: Jun. 12, 2012

(54) AIR DISTRIBUTION BLOWER HOUSING WITH ADJUSTABLE RESTRICTION

(75) Inventor: Craig S. Messmer, St. Louis, MO (US)

(73) Assignee: Unico, Inc., St. Louis, MO (US)

( * ) Notice: Subject to any disclaimer, the term of this patent is extended or adjusted under 35 U.S.C. 154(b) by 1076 days.

(21) Appl. No.: 12/114,407

(22) Filed: May 2, 2008

(65) Prior Publication Data

US 2009/0274551 A1 Nov. 5, 2009

(51) Int. Cl.
*F04D 29/46* (2006.01)

(52) U.S. Cl. ..... 415/126; 415/211.2

(58) Field of Classification Search ..... 415/119, 415/126, 211.2
See application file for complete search history.

(56) References Cited

U.S. PATENT DOCUMENTS

| | | | | |
|---|---|---|---|---|
| 2,640,410 | A * | 6/1953 | Raider et al. | 236/49.3 |
| RE24,421 | E * | 1/1958 | Patrick | 236/10 |
| 3,628,441 | A * | 12/1971 | Ardussi et al. | 454/290 |
| 3,662,557 | A | 5/1972 | Morgan | |
| 4,479,921 | A | 10/1984 | Allaire et al. | |
| 4,934,335 | A | 6/1990 | Marlatt | |
| 4,977,750 | A | 12/1990 | Metcalfe | |
| 5,186,237 | A | 2/1993 | Adasek et al. | |
| 5,277,036 | A | 1/1994 | Dieckmann et al. | |
| 5,792,230 | A * | 8/1998 | Moore et al. | 55/493 |
| 6,890,149 | B2 | 5/2005 | Metz et al. | |
| 6,899,516 | B2 * | 5/2005 | Wang | 415/60 |
| 6,979,169 | B2 | 12/2005 | Penlesky et al. | |
| 2001/0014284 | A1 | 8/2001 | McCabe | |
| 2003/0084896 | A1 | 5/2003 | Gierula et al. | |
| 2005/0087614 | A1 | 4/2005 | Ruise | |
| 2006/0000110 | A1 | 1/2006 | Aisenberg et al. | |

* cited by examiner

*Primary Examiner* — Nathaniel Wiehe
*Assistant Examiner* — Andrew C Knopp
(74) *Attorney, Agent, or Firm* — Thompson Coburn LLP

(57) ABSTRACT

An air distribution blower housing has an adjustable restriction in the interior of the blower housing. The adjustable restriction has the configuration of a rectangular plate. One edge of the plate is connected by a pivoting connection to an interior wall of the blower housing in the air flow path from the blower housing. The plate can be pivoted about the pivot connection through a plurality of adjusted angular positions of the plate in the air flow path. In each adjusted position of the plate, the length of the plate extends from the pivot connection in the air flow direction. A sliding connection is provided between the plate and at least one side wall of the blower housing. The sliding connection selectively holds the plate in its adjusted angular position and also provides a visual indication on the exterior of the blower housing of the adjusted angular position of the plate inside the blower housing.

13 Claims, 3 Drawing Sheets

AIR DISTRIBUTION BLOWER HOUSING WITH ADJUSTABLE RESTRICTION

BACKGROUND OF THE INVENTION

1. Field of the Invention

The present invention pertains to an air distribution blower housing that has an adjustable restriction in the interior of the blower housing. The adjustable restriction has the configuration of a rectangular plate. One edge of the plate is connected by a pivoting connection to a wall of the blower housing in the air flow path from the blower housing. The plate can be pivoted about the pivot connection through a plurality of adjusted angular positions of the plate in the air flow path. In each adjusted position of the plate, the length of the plate extends from the pivot connection in the air flow direction. A sliding connection is provided between the plate and at least one side wall of the blower housing. The sliding connection selectively holds the plate in its adjusted angular position and also provides a visual indication on the exterior of the blower housing of the adjusted angular position of the plate inside the blower housing.

2. Description of the Related Art

Air condition systems are currently designed with an adjustable capacity. This adjustable capacity enables manufacturers of the systems, distributors of the systems, or contractors that install the systems to meet the different requirements of a relatively wide range of HVAC installations used in a relatively wide range of building constructions. These conditioning systems can be operated in a wide range of cooling capacities by employing a cooling module having a condensing unit of the required capacity for the particular building construction, and by adjusting the volume rate of air flow through the system.

A typical air conditioning system that employs the prior art restrictor plate to adjusts the air flow distribution from the system is disclosed in the U.S. Patent of Dieckmann et al. U.S. Pat. No. 5,277,036, the disclosure of which is incorporated herein by reference. An air conditioning system of this type typically includes a heating module, a cooling coil or module, and a blower.

The cooling module, the heating module, and the blower are typically assembled so that operation of the blower draws an air flow through the system. The drawn air flow direction is through the heating module, then through the cooling module, and then through the blower. This sequence of the air flow direction is desirable because if the cooling coil of the cooling module produces an air flow at below freezing temperature, then the heating coil of the heating module will not freeze and potentially burst.

The heating coil assembly functions as a heat exchanger that heats the air drawn through the coils by operation of the blower. The coils of the assembly typically communicate with a source of hot water and channel the hot water through the coils. The hot water heats the air drawn through the heating coil assembly by the operation of the blower.

The air flow volume of the air drawn through the system by operation of the blower is typically adjusted according to the cooling capacity of the condensing unit of the cooling coil of the system. The air flow volume rate is adjusted to achieve a constant air flow volume rate per unit of cooling capacity, for example, 200 cubic feet per minute (CFM) per ton.

In the prior art, a variable restrictor plate has been employed to fine tune the air flow to reduce the noise from the register if the total air flow is more than the minimum required. If noise is not an issue, then having more air flow than the minimum is better. Thus, most of the time the restrictor plate will be in the fully opened position. The prior art adjustable restrictor plate is slidably mounted across a discharge opening of a duct or a discharge opening of a blower housing. The plate is positioned substantially perpendicular to the direction of air flow. Movement of the plate across the discharge opening varies the area of the opening according to the air flow volume rate required for the cooling capacity desired of the system. These prior art adjustable restrictor plates have been seen to be disadvantaged in that the adjustable positioning of the plate across the discharge opening disrupts a smooth flow of air through the discharge opening. This disruption in the smooth flow of air through the discharge opening has been observed to negatively affect the efficiency of the air conditioning system blower. In addition, the adjustable positioning of the restrictor plate across the air discharge opening has the negative effect of generating noise due to the air flow around the restrictor plate.

SUMMARY OF THE INVENTION

The present invention provides an air distribution adjustable restriction that improves blower efficiency at lower air volumes of discharge from a blower housing and is quieter than prior art adjustable restrictor plates.

The air distribution adjustable restriction of the present invention could be employed in a duct that conducts air flow in an air flow direction through the duct. However, in the preferred embodiment of the invention the air distribution adjustable restriction is basically comprised of a restrictor plate in a blower housing, and in particular a centrifugal (squirrel cage) blower housing having a volute-shaped outer wall and a rectangular air flow outlet opening.

The restrictor plate is attached to a bottom wall of the blower housing adjacent the air flow outlet opening of the blower housing. In the preferred embodiment the restrictor plate is rectangular and has a bottom edge, an opposite top edge, and opposite first and second side edges.

A pivot connection attaches the bottom edge of the restrictor plate to the blower housing bottom wall. The pivot connection enables the restrictor plate to be adjustably positioned in a plurality of adjusted angular positions of the plate relative to the bottom wall. In each of the adjusted angular positions, the length of the restrictor plate extending from the bottom edge to the top edge of the plate is oriented in the air flow direction.

A sliding connection is provided between at least one of the two side edges of the restrictor plate and an adjacent side wall of the blower housing. The sliding connection can selectively hold the restrictor plate in an adjusted angular position of the plate relative to the bottom wall of the blower housing. The sliding connection also provides a visual indication of the adjusted angular position of the restrictor plate in the interior of the blower housing from an exterior environment of the blower housing.

The air distribution adjustable restriction of the invention overcomes disadvantages associated with prior art restrictor plates by employing a restrictor plate that can only be adjusted to an angular position in which a length of the restrictor plate extends in the air flow direction for all adjusted positions of the restrictor plate. This provides a smooth air path across the restrictor plate in all of the adjusted positions of the restrictor plate. The air flow across the restrictor plate is smoother and quieter than that of prior art restrictor plates. In addition the air distribution adjustable restriction of the invention creates a back pressure upstream of the restrictor plate without creating a disruption in the air flow that reduces the efficiency of the blower used with the restrictor plate. In addition, the restrictor plate is an integral part of the blower housing, and therefore can be easily added to an air distribution system.

DETAILED DESCRIPTION OF THE PREFERRED EMBODIMENT

Figure 1:
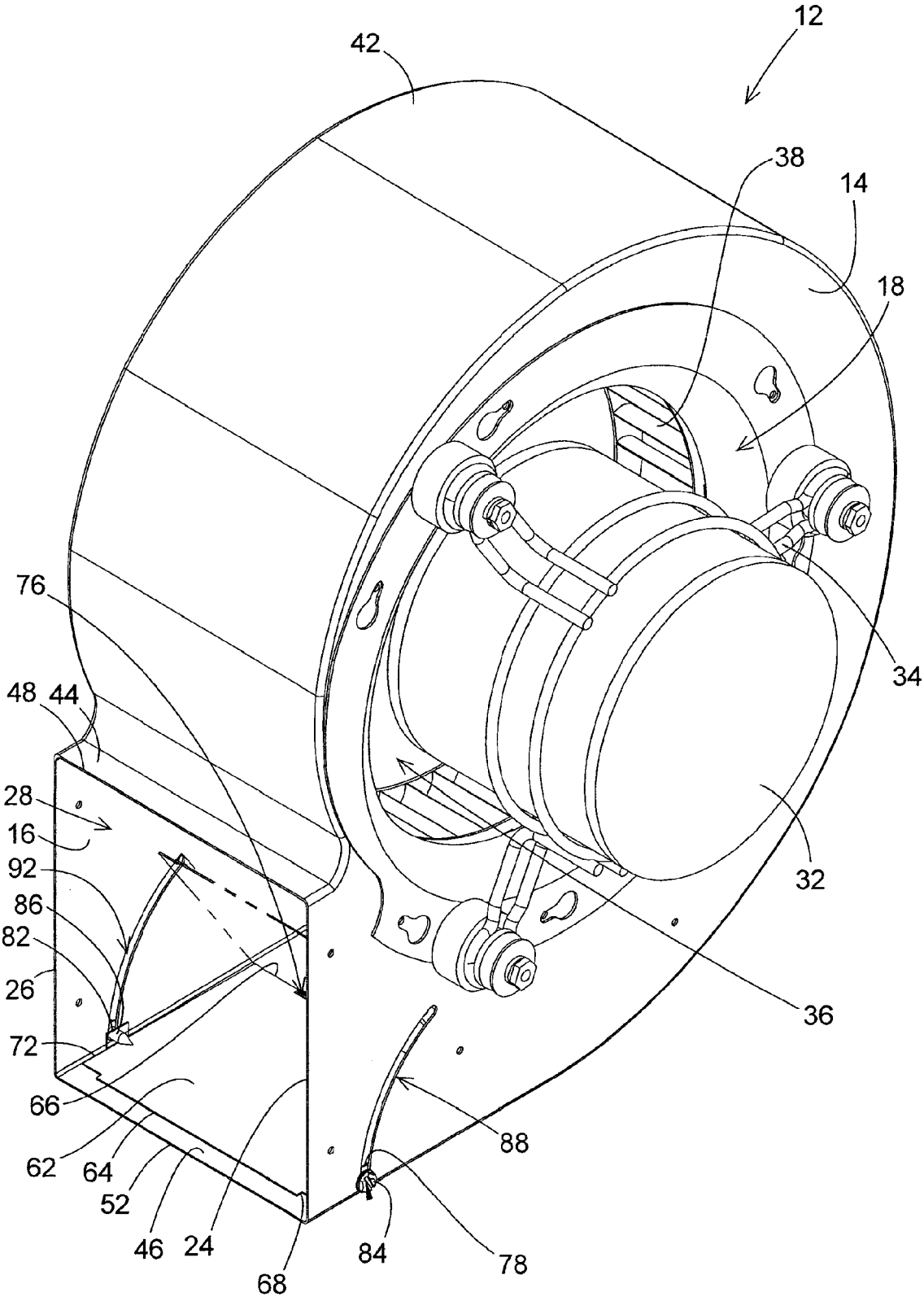
FIG. 1 is a perspective view of a blower housing employing the air distribution adjustable restriction of the present invention.
Figure 2:
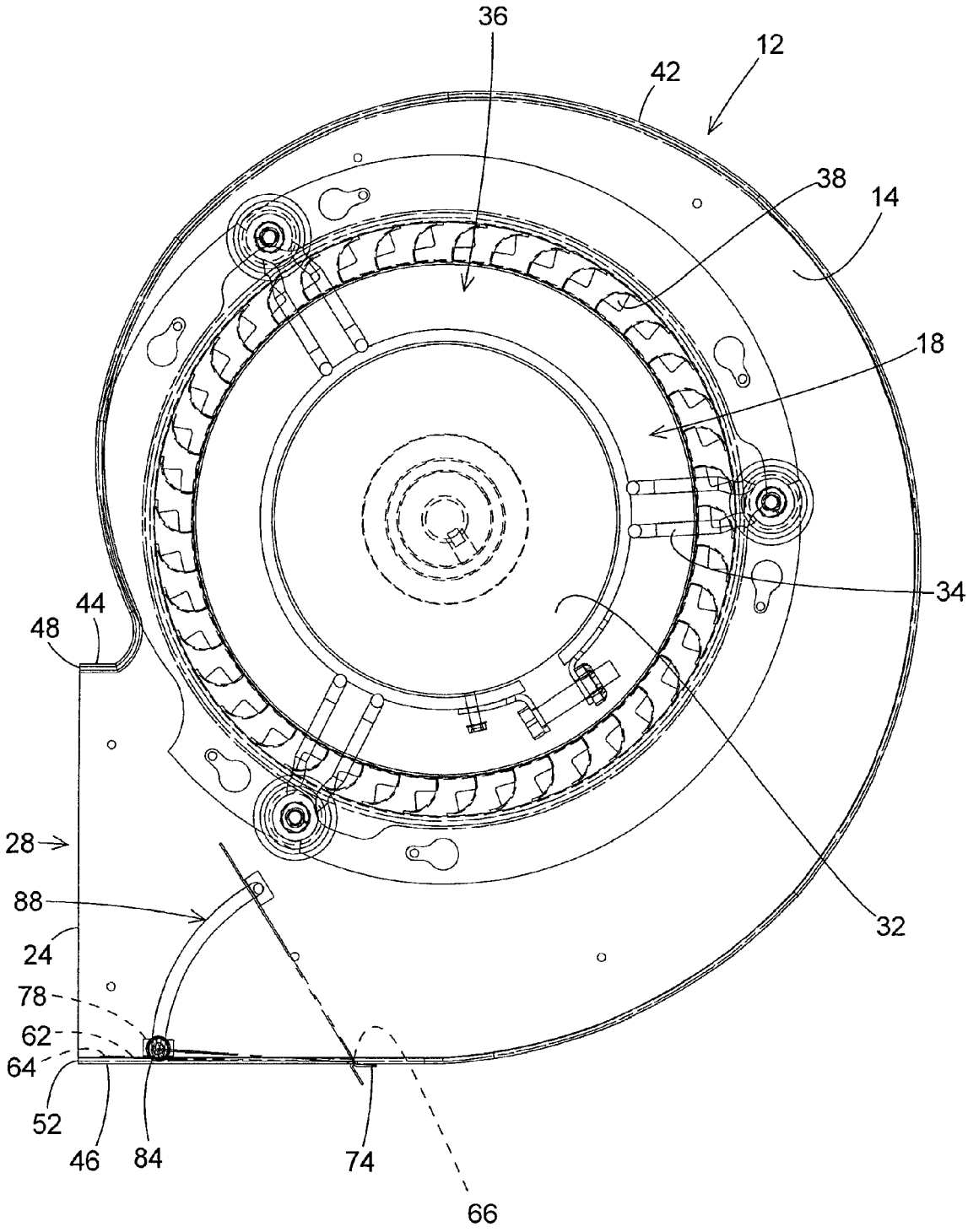
FIG. 2 is a side elevation view of the air distribution adjustable restriction shown in FIG. 1.
Figure 3:
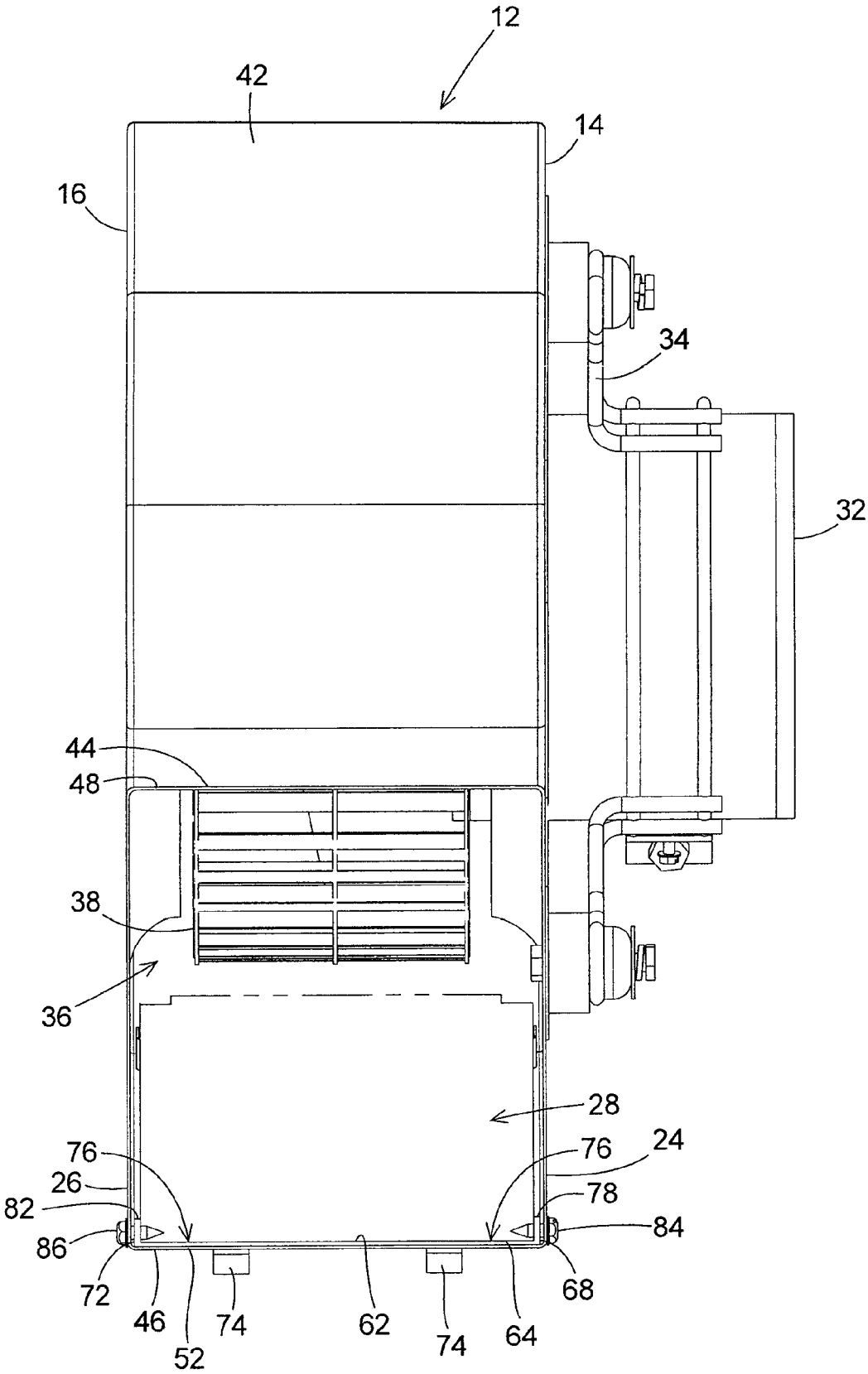
FIG. 3 is an elevation view of the air distribution adjustable restriction shown from the left in FIG. 2.

FIGS. 1-3 show the air distribution blower housing with an adjustable restriction 12 of the invention. In the preferred embodiment, the basic concept of the invention is employed in a air distribution blower housing such as that shown in the drawing figures. However, the concept of the invention could be used in other environments, for example in a portion of an air distribution duct having a rectangular cross-section. Although in the preferred embodiment the basic concept of the invention is employed in a blower housing, this should not be interpreted as limiting The air distribution blower housing with an adjustable restriction 12 comprises a blower housing construction having features commonly found in prior art blower housing constructions. Referring to FIG. 1, the blower housing includes a first sidewall 14 and a second side wall 16. These two side walls 14, 16 are substantially identical to each other, except that the first side wall 14 is provided with a motor opening 18, and the second side wall 16 is provided with an air inlet opening (not shown). The first 14 and second 16 side walls have respective first 24 and second 26 outlet edges positioned on opposite sides of an air flow outlet opening 28 of the blower housing.

A motor 32 mounted on a supporting frame 34 is secured to the first side wall 14 of the blower housing. A shaft (not shown) of the motor 32 extends into the blower housing interior 36 defined between the two side walls 14,16. A fan 38, preferably a fan wheel or impeller type fan is mounted on the motor shaft in the housing interior 36.

The blower housing also has a volute or scroll shaped outer wall 42 that extends around the blower housing and is connected between the first side wall 14 and the second side wall 16. As viewed in FIG. 1, the outer wall 42 extends around the housing in a rotation direction of the fan 38 from a top outer wall portion 44 to a bottom outer wall portion 46. The outer wall 42 has the typical volute shape of air distribution blower housings as it extends from the top wall portion 44 around the interior volume of the housing to the bottom wall portion 46. The top wall portion 44 has a top edge 48 positioned on an opposite side of the air flow outlet opening 28 from a bottom edge 52 of the bottom wall portion 46. Together the top wall edge 48 and opposite bottom wall edge 52, and the first side wall outlet edge 24 and second side wall outlet edge 26 define a rectangular shaped air flow outlet opening 28 of the blower housing. The air flow generated by operation of the motor 32 and rotation of the fan wheel 38 produces an air flow in an air flow direction through the air flow outlet opening 28 from the housing interior 36.

The construction of the air distribution blower housing 12 described above is, for the most part, conventional. The novel features of the invention include a restrictor plate 62 that is assembled to the blower housing 12 in the blower housing interior 36, and the adjustable connection of the restrictor plate 62 to the blower housing 12.

The restrictor plate 62 is basically a rectangular shaped plate having opposite top 64 and bottom 66 edges, and opposite first 68 and second 72 side edges. The plate top edge 64 and bottom edge 66 are substantially straight and parallel edges, except for a pair of plate bottom tabs 74 that project from the plate bottom edge 66. The plate bottom tabs 74 are received in a pair of slots 76 provided through the blower housing outer wall 42. The engagement of the tabs 74 in the blower housing slots 76 provide a pivoting connection of the plate 62 to the blower housing. With the tabs 74 engaged in the slots 76, the restrictor plate 72 can pivot through a plurality of adjustable angular positions in the interior of the blower housing 28 adjacent the air flow outlet opening 28. The slots 76 are positioned sufficiently back from the air flow outlet opening 28 to prevent the plate 62 from extending through the air flow outlet opening 28 when the plate is adjustably positioned against the bottom wall portion 46 of the housing outer wall 42 as shown in FIG. 1. The maximum adjusted angular position of the restrictor plate 62 is shown in dashed lines in FIGS. 1-3.

The restrictor plate first 68 and second 72 side edges are substantially straight, parallel edges except for a pair of side tabs 78, 82 that project from the side edges. The width dimension of the restrictor plate 62 is such that the side edges 68, 72 are positioned in close proximity to the respective side walls 14,16 of the blower housing. The side tabs 78, 82 are bent from the side edges 68, 72 to project into the interior volume of the blower housing. Each of the side tabs 78, 82 has a hole that receives a threaded post or shank of a respective threaded fastener 84, 86.

A pair of curved slots 88, 92 are provided through the respective first 14 and second 16 side walls of the blower housing adjacent the respective side edges 68, 72 of the restrictor plate 62. The curved slots 88, 92 receive the threaded fasteners 84, 86 that are threaded into the holes in the respective side tabs 78, 82. Thus, as the restrictor plate is pivoted in the blower housing interior 36 through a plurality of adjusted angular positions of the restrictor plate 62 relative to the housing bottom wall portion 46, the pair of fasteners 84, 86 slide through the curved slots 88, 92. The positions of the fasteners 84, 86 in the curved slots 88, 92 gives a visual indication from the exterior of the blower housing 1 2 of the adjusted angular position of the restrictor plates 62 in the blower housing interior 36. With the restrictor plate 62 positioned at a desired angle, the threaded fasteners 84, 86 can be screwed down to engage against the respective side walls 14, 16 of the blower housing to securely hold the restrictor plate 62 in its adjusted angular position.

Thus, the air distribution blower housing with the adjustable restrictor plate adjusts the air flow volume rate through the air flow outlet opening 28. The configuration of the curved slots 88, 92 ensures that in the adjusted angular position of the restrictor plate 62, the orientation of the restrictor plate 62 from the plate bottom edge 66 to the plate top edge 64 is always in the air flow direction through the air flow outlet opening 28. With this orientation of the restrictor plate 62 the plate does not disrupt the smooth flow of air through the air flow outlet opening 28, and therefore does not negatively affect the efficiency of the air distribution blower. In addition, the adjustable positioning of the restrictor plate with the plate oriented in the air flow direction does not generate the same noise as the prior art restrictors where the air flow is around the restrictor plate.

Although the air distribution blower housing of the invention has been described above by referring to a specific embodiment, other variations and modifications could be made to the described embodiment without departing from the intended scope of the following claims.

The invention claimed is:

1. An air distribution adjustable restriction comprising:

a blower housing having first and second side walls, a top wall and a bottom wall that are connected together to define a rectangular air flow outlet opening of the blower housing and an air flow path having an air flow direction from the blower housing and through the air flow outlet opening;

a rectangular restrictor plate attached to the blower housing bottom wall in the air flow path, the restrictor plate having a bottom edge, a top edge opposite the bottom edge, and first and second side edges on opposite sides of the restrictor plate;

a pivot connection connecting the restrictor plate bottom edge to the blower housing bottom wall for pivoting movement of the restrictor plate through a plurality of adjusted angular positions of the restrictor plate relative to the bottom wall where in each adjusted position the restrictor plate extends in the air flow direction from the bottom edge to the top edge of the restrictor plate; and, a sliding connection attaching at least one of the restrictor plate first and second side edges to the respective first and second side walls of the blower housing to hold the restrictor plate in an adjusted angular position relative to the blower housing bottom wall, the sliding connection also providing a visual indication of the adjusted angular position of the restrictor plate inside the blower housing from an exterior environment of the blower housing.

2. The air distribution adjustable restriction of claim 1, further comprising:

the restrictor plate having a length from the restrictor plate bottom edge to the restrictor plate top edge that prevents the restrictor plate top edge from passing through the air flow outlet of the blower housing in any of the adjusted angular positions of the restrictor plate.

3. The air distribution adjustable restriction of claim 1, further comprising:

the sliding connection comprises a curved slot in the one of the first and second side walls of the blower housing and a post that extends through the slot and is attached to the restrictor plate where a position of the post in the slot provides the visual indication of the adjusted angular position of the restrictor plate from the exterior environment of the blower housing.

4. The air distribution adjustable restriction of claim 3, further comprising:

the post being a threaded screw that extends through the slot and is attached to the restrictor plate for screwing the screw toward the restrictor plate and into contact with the one of the first and second side walls of the blower housing to hold the restrictor plate in an adjusted angular position relative to the blower housing bottom wall, and for unscrewing the screw from the restrictor plate and out of contact with the one of the first and second side walls of the blower housing to release the restrictor plate for movement through the plurality of adjusted positions.

5. The air distribution adjustable restriction of claim 4, further comprising:

the curved slot being one of a pair of first and second curved slots in the respective first and second side walls of the blower housing and the screw being one of a pair of first and second screws extending through the respective first and second slots and attached to the restrictor plate.

6. The air distribution adjustable restriction of claim 1, further comprising:

the blower housing bottom wall having at least one hole through the bottom wall; and, the restrictor plate having a tab that projects from the bottom edge of the restrictor plate and into the hole through the blower housing bottom wall thereby providing the pivot connection connecting the restrictor plate bottom edge to the blower housing bottom wall.

7. An air distribution adjustable restriction comprising:

a blower housing having a volute shaped outer wall, and first and second side walls connected to opposite sides of the outer wall, the outer wall having a top wall end at an air flow outlet opening of the blower housing and a length that extends from the top wall end through the volute shape of the outer wall around an interior volume of the blower housing to a bottom wall end of the outer wall positioned on an opposite side of the air flow outlet opening from the top wall end, together with the first and second side walls, the top wall end and the bottom wall end defining a rectangular configuration of the air flow outlet opening;

a fan mounted for rotation in the blower housing interior volume where rotation of the fan creates an air flow in an air flow direction that exits the blower housing through the air flow outlet opening; and, a rectangular restrictor plate connected to the blower housing in the air flow outlet opening, the restrictor plate having a bottom edge, a top edge opposite the bottom edge, and first and second side edges on opposite sides of the restrictor plate;

a pivot connection connecting the restrictor plate bottom edge to the blower housing outer wall for pivoting movement of the restrictor plate through a plurality of adjusted positions of the restrictor plate where the restrictor plate is oriented at an angle relative to the blower housing outer wall and where a length of the restrictor plate extending from the bottom edge to the top edge extends in the air flow direction; and, a sliding connection attaching at least one of the restrictor plate first and second side edges to the respective first and second side walls of the blower housing to hold the restrictor plate in an adjusted position of the plurality of adjusted positions.

8. The air distribution adjustable restriction of claim 7, further comprising:

the sliding connection also providing a visual indication of the adjusted angular position of the restrictor plate inside the blower housing from an exterior environment of the blower housing.

9. The air distribution adjustable restriction of claim 8, further comprising:

the restrictor plate extending in the air flow direction from the restrictor plate bottom edge to the restrictor plate top edge in all of the plurality of adjusted positions of the restrictor plate.

10. The air distribution adjustable restriction of claim 9, further comprising:

the sliding connection comprises a curved slot in the one of the first and second side walls of the blower housing and a post that extends through the slot and is attached to the restrictor plate where a position of the post in the slot provides the visual indication of the adjusted angular position of the restrictor plate from the exterior environment of the blower housing.

11. The air distribution adjustable restriction of claim 10, further comprising:

the post being a threaded screw that extends through the slot and is attached to the restrictor plate for screwing the screw toward the restrictor plate and into contact with the one of the first and second side walls of the blower housing to hold the restrictor plate in an adjusted angular position relative to the blower housing outer wall, and for unscrewing the screw from the restrictor plate and out of contact with the one of the first and second side walls of the blower housing to release the restrictor plate for movement through the plurality of adjusted positions.

12. The air distribution adjustable restriction of claim 11, further comprising:

the curved slot being one of a pair of first and second curved slots in the respective first and second side walls of the blower housing and the screw being one of a pair of first and second screws extending through the respective first and second slots and attached to the restrictor plate.

13. The air distribution adjustable restriction of claim 12, further comprising:

the blower housing outer wall having at least one hole through the outer wall; and, the restrictor plate having a tab that projects from the bottom edge of the restrictor plate and into the hole through the bottom wall thereby providing the pivot connection connecting the restrictor plate bottom edge to the bottom wall.

* * * * *